US005145313A

United States Patent [19]

Weyer

[11] Patent Number: 5,145,313

[45] Date of Patent: Sep. 8, 1992

[54] QUICK DISCONNECT BUCKET ACTUATOR

[76] Inventor: Paul P. Weyer, P.O. Box 398, Enumclaw, Wash. 98022

[21] Appl. No.: 722,865

[22] Filed: Jun. 28, 1991

[51] Int. Cl.[5] ..... E02F 3/36

[52] U.S. Cl. ..... 414/723; 74/99 A; 74/469; 403/15

[58] Field of Search ..... 414/723, 694; 37/103, 37/118 R; 403/15, 36, 38; 74/99 A, 469; 901/41

[56] References Cited

U.S. PATENT DOCUMENTS

| | | | |
|---|---|---|---|
| 4,042,131 | 8/1977 | Buttke | 214/138 |
| 4,277,899 | 7/1981 | Güthoff | 37/103 |
| 4,307,991 | 12/1981 | Birdwell et al. | 414/694 X |
| 4,639,183 | 1/1987 | Güthoff | 414/705 |
| 4,906,161 | 3/1990 | Weyer | 414/705 |
| 4,944,628 | 7/1990 | Hulden | 414/723 X |

OTHER PUBLICATIONS

Raine, "Tilt Bucket", B1192-8 (Feb. 1988).

Wain-Roy, Inc., "The Wain-Roy ®Rota-Jaw Bucket", WR-002 CP-10M-Feb. 1985.

*Primary Examiner*—Robert J. Spar

*Assistant Examiner*—Donald W. Underwood

*Attorney, Agent, or Firm*—Seed and Berry

[57] ABSTRACT

A fluid-powered, laterally tiltable quick disconnect bucket actuator. A bucket has a pair of bucket clevises, and an actuator has a generally cylindrical body with an output shaft rotatably disposed therein with an axis in general parallel alignment with a forward rotation plane through which the bucket is rotatable on a backhoe arm by the operation of a rotation link. A bracket is attached to the body and has a pair of clevises for pivotal attachment to the vehicle arm and rotation link. The output shaft has a pair of shaft attachmetn forks for each end for attaching the shaft to the corresponding bucket clevises. The one pair of shaft attachment forks is attached to and moves axially with a member which is selectively extendable relative to the shaft to move the pair of forks between a locking position holding the bucket and a release position allowing disconnection of the bucket. A linear-to-rotary transmission device disposed within the body produces rotational movement of the shaft relative to the body to produce lateral tilting of the bucket in a lateral plane generally transverse to the forward rotational plane for the bucket.

23 Claims, 6 Drawing Sheets

QUICK DISCONNECT BUCKET ACTUATOR

DESCRIPTION

1. Technical Field

The present invention relates generally to backhoes and excavators and, more particularly, to buckets and other tools which are laterally tiltable.

2. Background of the Invention

Backhoes, excavators and similar type vehicles have an extendable or articulated arm with a tool such as a bucket attached at an end thereof remote from the operator. Generally, a rotation link is associated with the arm. The bucket is pivotally attached to the arm by a clevis which serves as a pivot point for the bucket. The rotation link is also pivotally attached to the bucket so that movement of the rotation link causes the bucket to rotate about the arm pivot point. With such an arrangement, the bucket can be rotated relative to the arm in a generally vertical, forwardly extending plane defined by the arm and the rotation link, but lateral tilting of the bucket is not possible, at least without tilting of the vehicle. The arm and rotation link are usually not laterally tiltable relative to the vehicle to which they are attached.

There are occasions, however, when it would be very desirable to work with the bucket tilted to the left or right, such as when necessary to adjust for slope requirements or to do side-angle grading. It is, of course, undesirable and often not possible to laterally tilt the entire vehicle to achieve tilting of the bucket. This problem has been overcome with the advent of laterally tiltable buckets. Such buckets generally include a hinge adaptor which is attached to the arm and the rotation link, much in the same way buckets were directly attached in the past. The adaptor serves as a hinge and pivotally supports a bucket for lateral rotation of the bucket about a hinge axis which is generally aligned with the forward rotation plane through which the bucket is conventionally rotated. This allows the bucket to be laterally tilted from side to side. Control of the amount of lateral tilting is accomplished using a double-acting cylinder which extends laterally between the hinge adaptor and the bucket to selectively cause the bucket to rotate about the hinge axis. Extension of the double-acting cylinder causes the bucket to rotate to one side, and retraction of the cylinder causes it to rotate to the other side.

To achieve the desirable range of tilting, such an arrangement has required a relatively long, double-acting cylinder. As such, only relatively wide buckets could accommodate the amount of extension and retraction of the double-acting cylinder required to laterally tilt the bucket to the extent desired. The more tilting required, the greater the space required to handle the double-acting cylinder to be used, because greater extension is needed. Of course, space limitations not only limit the length of the double-acting cylinder which can be used, but also the torque output achievable with the cylinder. The use of a bucket that is wide enough to accommodate the elongated double-acting cylinders does not always solve these problems, because certain type jobs can best be done only with relatively narrow buckets. Typically, it is desired to have tiltable buckets tilt 45 degrees to the left and to the right relative to the vertical.

The need for a laterally tiltable bucket assembly which uses a relatively narrow width bucket has been largely met by the present inventor's Tiltable Bucket Assembly described in U.S. Pat. No. 4,906,161. That bucket assembly can transmit large torque to the bucket and firmly hold the bucket at the desired tilt angle.

That bucket assembly does not, however, provide means for quickly disconnecting the bucket or other tool from the vehicle arm and rotation link, but rather requires the operator to remove the pins which hold the bucket in place and re-insert them for the next tool to be attached. This is a slow and sometimes difficult process.

It will, therefore, be appreciated that there has been a significant need for a laterally tiltable bucket assembly which can quickly and easily disconnect and re-connect the bucket or another tool. The present invention fulfills this need and further provides other related advantages.

SUMMARY OF THE INVENTION

The present invention resides in a fluid-powered actuator, usable with a vehicle having an arm and a rotation link associated therewith for rotation of a tool in a first plane defined by movement of the rotation link relative to the arm. The arm and the rotation link each has an attachment member located toward a free end thereof. The tool with which the actuator is usable has a first tool attachment member and a second tool attachment member located away from the first tool attachment member. The first and second tool attachment members are arranged in general parallel alignment with the first plane. In one embodiment of the invention, the tool is a bucket and the invention is in the form of a fluid-powered laterally tiltable bucket assembly.

The tool actuator comprises a body having a longitudinal axis and first and second ends. An attachment bracket is rigidly attached to the body and has an external first bracket attachment member located generally along the body axis for pivotal attachment of the vehicle arm by the vehicle arm attachment member and an external second bracket attachment member located generally along the body axis away from the first bracket attachment member for pivotal attachment of the rotation link by the rotation link attachment member. The first and second bracket attachment members are selectively detachable from the arm and rotation link attachment members. When the arm and rotation link attachment members are attached to the attachment bracket, movement of the rotation link causes the body to rotate about the vehicle arm with movement of the longitudinal axis of the body in general parallel alignment with the first plane. The tool actuator is selectively detachable from the vehicle arm and the rotation link.

The tool actuator further includes an output shaft rotatably disposed within the body in general coaxial arrangement with the body. The shaft has a first shaft end portion extending at least to the first body end and a second shaft end portion extending toward the second body end. The first shaft end portion has a first shaft attachment member attached thereto which is releasably attachable to the first tool attachment member.

The tool actuator also includes a member which is longitudinally extendable relative to the second shaft end portion. The extendable member has a second shaft attachment member attached thereto which is releasably attached to the second tool attachment member. The extendable member is selectively extendable between a locking position with the first and second shaft attachment members positioned to attach the tool to the shaft for rotation with the shaft through a second plane extending laterally, generally transverse to the first plane, and a release position with the first and second shaft attachment members positioned to allow disconnection of the tool from the shaft.

The tool actuator also includes a linear-to-rotary torque transmitting member mounted for longitudinal movement within the body in response to selective application of pressurized fluid thereto. The torque-transmitting member engages the body and the shaft to translate longitudinal movement of the torque-transmitting member into rotational movement of the shaft relative to the body. In such manner, the tool is rotatable in the first plane and laterally tiltable in the second plane.

In a preferred embodiment of the invention, the second shaft end portion has a longitudinally extending aperture therein with an open end toward the second body end. The extendable member has a first end portion movably disposed within the shaft aperture and a second end portion extending out of the shaft open end. The second shaft attachment member is attached to the extendable member second end portion. In this embodiment, the tool actuator further includes a selectively operable member actuator for selectively moving the extendable member longitudinally within the shaft aperture sufficiently to move the extendable member between the locking and release positions.

In the illustrated preferred embodiment of the invention, the first shaft end portion has an interiorly threaded aperture, and the member actuator includes a screw having a threaded end portion threadably received in the shaft threaded aperture. The screw also includes a mounting portion to which the extendable member is mounted for longitudinal movement with the screw. The screw is selectively rotatable relative to the shaft to rotate the screw threaded portion within the shaft threaded aperture and thereby selectively move the screw longitudinally relative to the shaft. The screw threaded portion has a sufficient length when rotated to longitudinally move the extendable member between the locking and release positions.

In the preferred embodiment of the invention, the first shaft attachment member includes a pair of laterally spaced-apart forks facing generally toward the second body end and the second shaft attachment member includes a pair of laterally spaced-apart forks facing generally toward the first body end. The pairs of forks are positioned to each engage and retain one of a pair of laterally extending pins which comprises the first and second tool attachment members. The pairs of forks are positioned to each engage and retain one of the pins for rotation and lateral tilting of the tool when the extendable member is in the locking position. The pair of forks comprising the second shaft attachment member is positioned to disengage the corresponding pin when the extendable member is in the release position to allow removal of the tool.

Other features and advantages of the invention will become apparent from the following detailed description, taken in conjunction with the accompanying drawings.

DETAILED DESCRIPTION OF THE INVENTION

Figure 1:
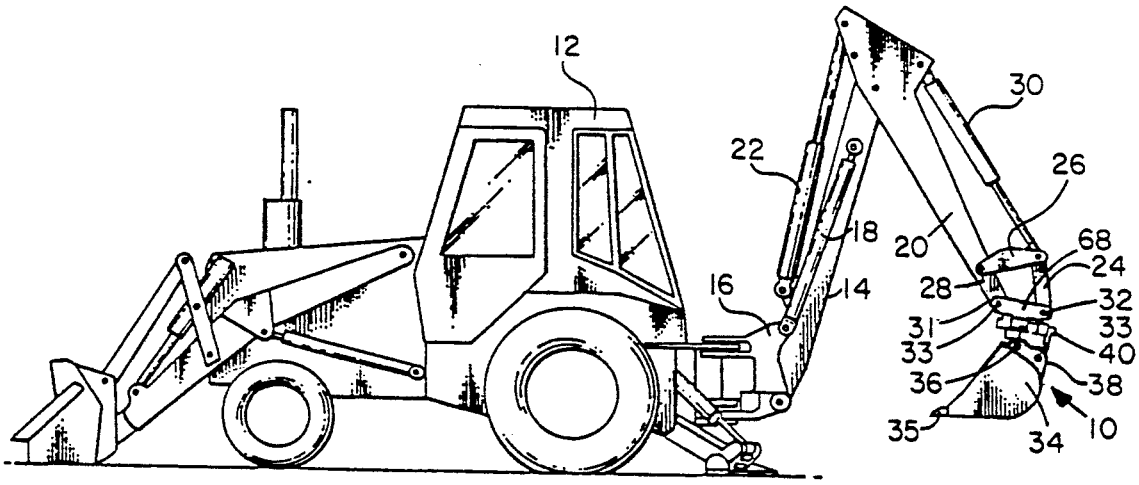
FIG. 1 is a left side elevational view of a backhoe shown with a laterally tiltable bucket assembly having a quick disconnect bucket actuator embodying the present invention.
Figure 2:
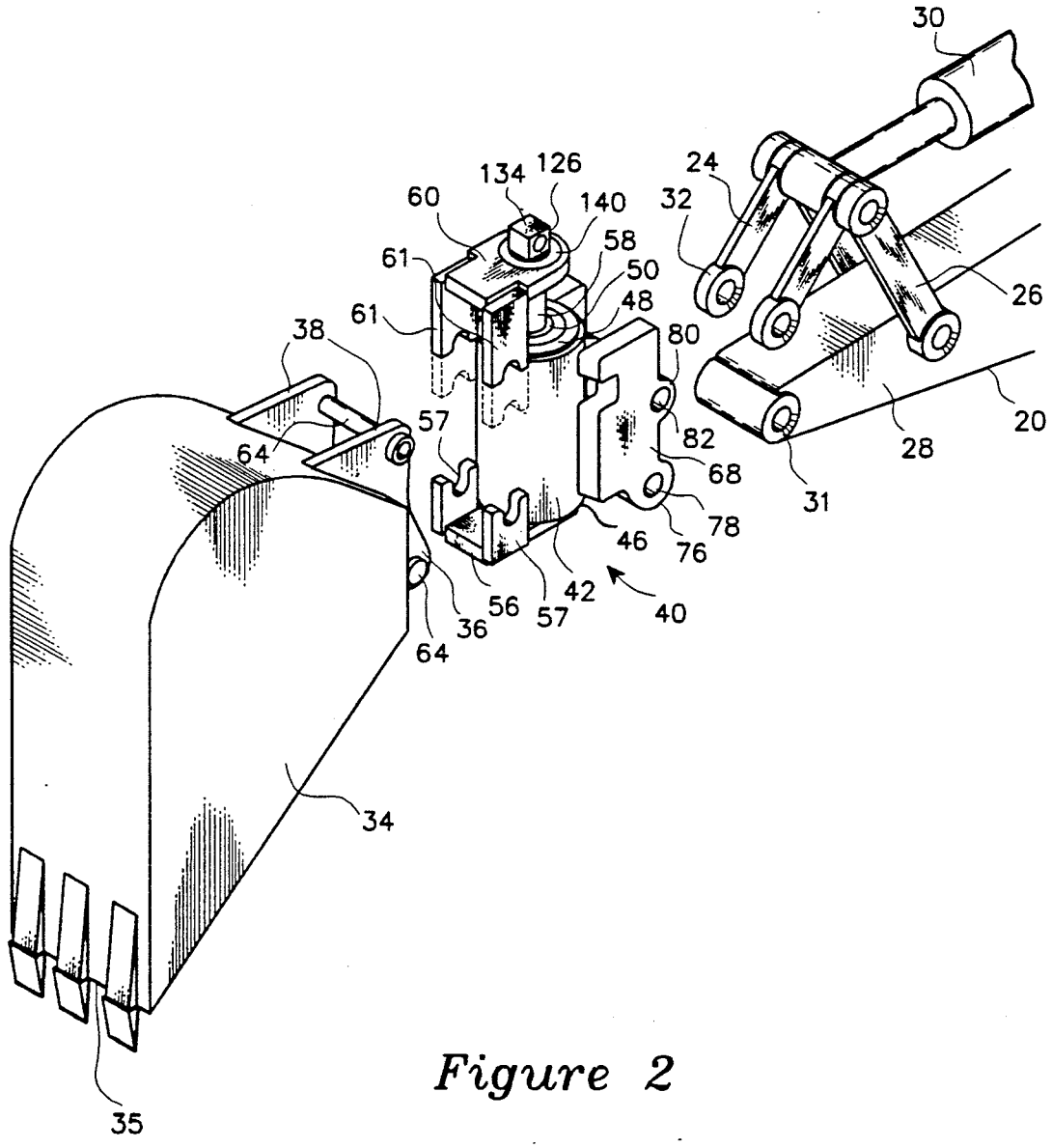
FIG. 2 is an enlarged, right side perspective view of the bucket assembly of FIG. 1 with the bucket disconnected from the bucket actuator and the bucket actuator disconnected from the arm and rotation link of the backhoe.
Figure 3:
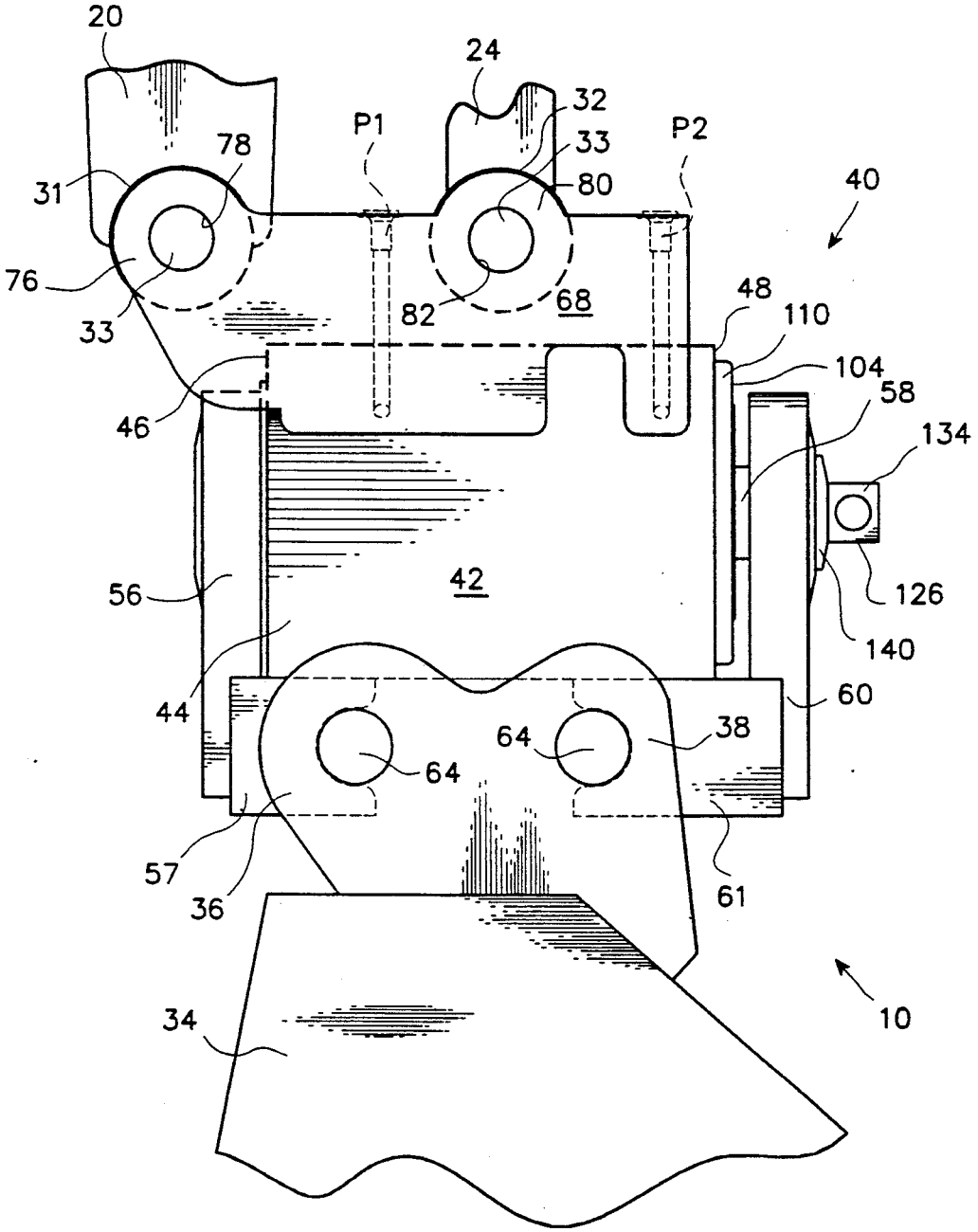
FIG. 3 is an enlarged, fragmentary, left side elevational view of thee bucket assembly of FIG. 1.

As shown in the drawings for purposes of illustration, the present invention is embodied in a fluid-powered, laterally tiltable bucket assembly, indicated generally by reference numeral 10. As shown in FIG 1, the bucket assembly is usable with a vehicle 12, such as the illustrated backhoe or any excavator or other vehicle that might use a bucket or other tool as a work implement. The vehicle 12 has a first arm 14 which is pivotally connected by one end to a base member 16. A pair of hydraulic cylinders 18 (only one being shown in FIG. 1) is provided for raising and lowering the first arm in a generally forwardly extending vertical plane with respect to the base member 16. A second arm 20 is pivotally connected by one end to an end of the first arm 14 remote from the base member 16. A hydraulic cylinder 22 is provided for rotation of the second arm 20 relative to the first arm 14 in the same vertical forward rotation plane as the first arm operates.

The base member 16 is pivotally attached to the vehicle 12 for pivotal movement about a vertical axis so as to permit movement of the first and second arms 14 and 20 in unison to the left or right, with the first and second arms always being maintained in the forward rotation plane. It is noted that while the forward rotation plane is referred to as being forwardly extending for convenience of description, as the base member 16 is pivoted the forward rotation plane turns about the vertical pivot axis of the base member and thus to a certain extent loses its forward-to-rearward orientation, with the plane actually extending laterally should the base member be sufficiently rotated.

A rotation link 24 is pivotally connected through an interconnecting link 26 to an end portion 28 of the second arm 20 remote from the point of attachment of the second arm to the first arm 14. A hydraulic cylinder 30 is provided for selective movement of the rotation link 24 relative to the second arm 20.

As is conventional, a free end portion 31 of the second arm 20 and a free end portion 32 of the rotation link 24 each has a transverse aperture therethrough for connection of the second arm and the rotation link to a conventional bucket using a pair of selectively removable attachment pins 33. The attachment pins 33 are insertable in the apertures to pivotally connect the conventional bucket to the second arm and the rotation link. When using the conventional bucket, this permits the bucket to be rotated about the attachment pin of the second arm 20 upon movement of the rotation link 24 relative to the second arm as a result of extension or retraction of the hydraulic cylinder 30 to rotate the bucket in the forward rotation plane defined by the first and second arms 14 and 20.

In the presently preferred embodiment of the invention, a conventional bucket 34 of relatively narrow width is utilized. The bucket has a toothed forward working edge 35 (see FIG. 1) extending laterally, generally transverse to the forward rotation plane of the bucket. The bucket 34 further includes a first bucket clevis 36 located toward the bucket working edge 35 and a second bucket clevis 38 located rearwardly away from the first bucket clevis. The first and second bucket clevises are in general parallel alignment with the forward rotation plane of the bucket. It should be understood that the present invention may be practiced using other tools as work implements, and is not limited to just operation with buckets.

Figure 4:
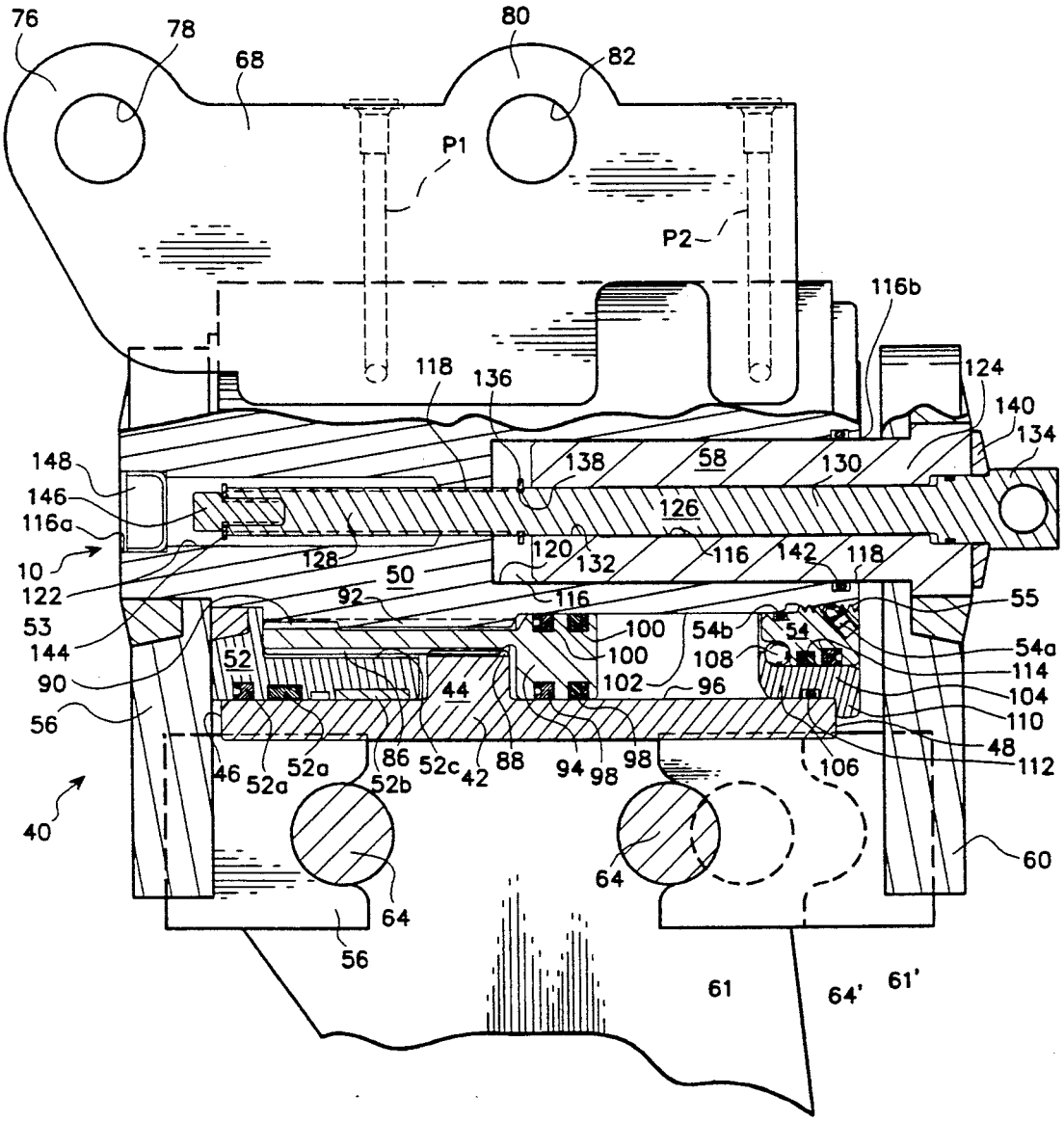
FIG. 4 is an enlarged, left side elevational view of the bucket actuator of FIG. 1 shown in partial sections taken substantially along the line of 4—4 of FIG. 5.
Figure 5:
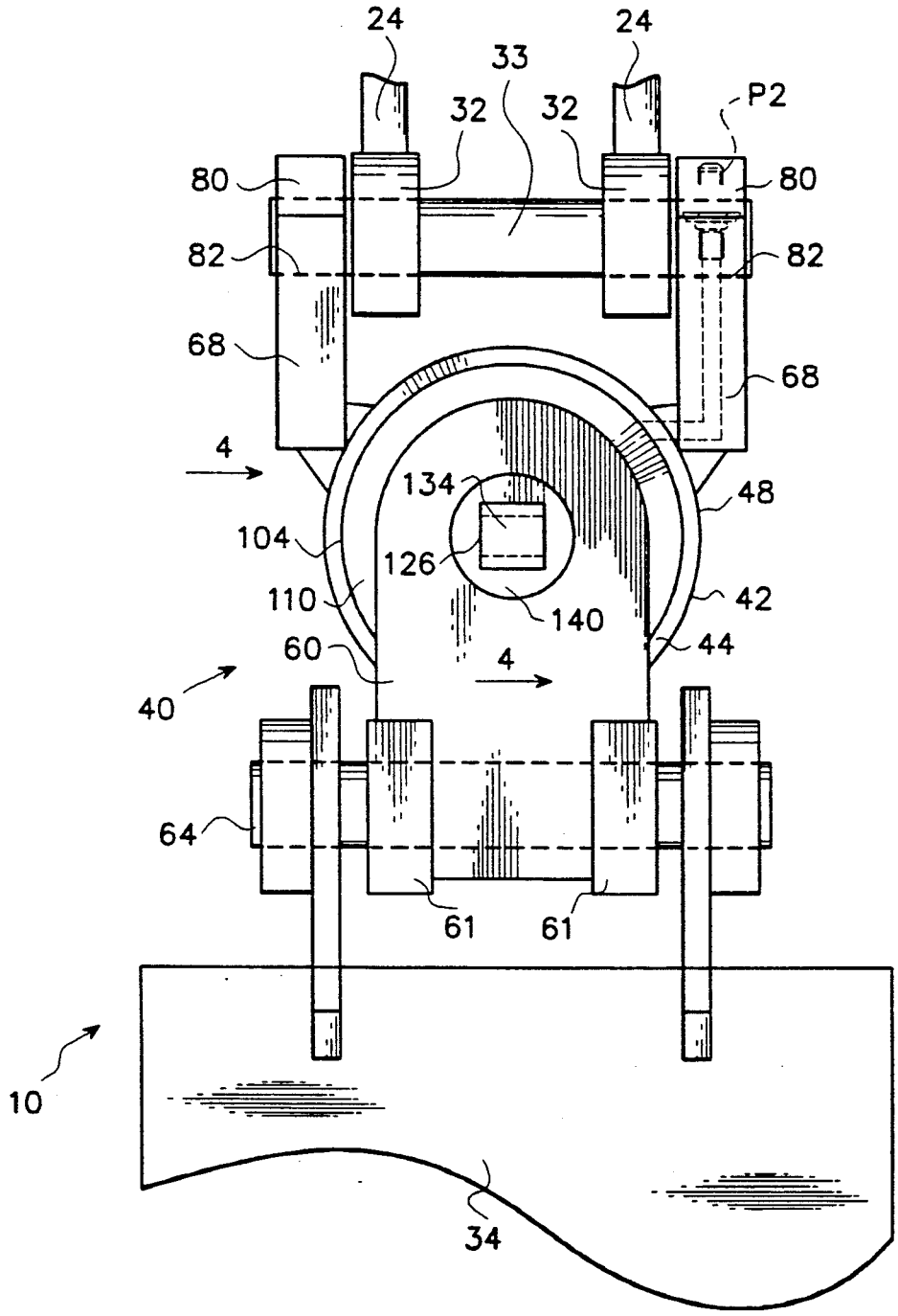
FIG. 5 is an enlarged, fragmentary, rear elevational view of the bucket assembly of FIG. 1.
Figure 6:
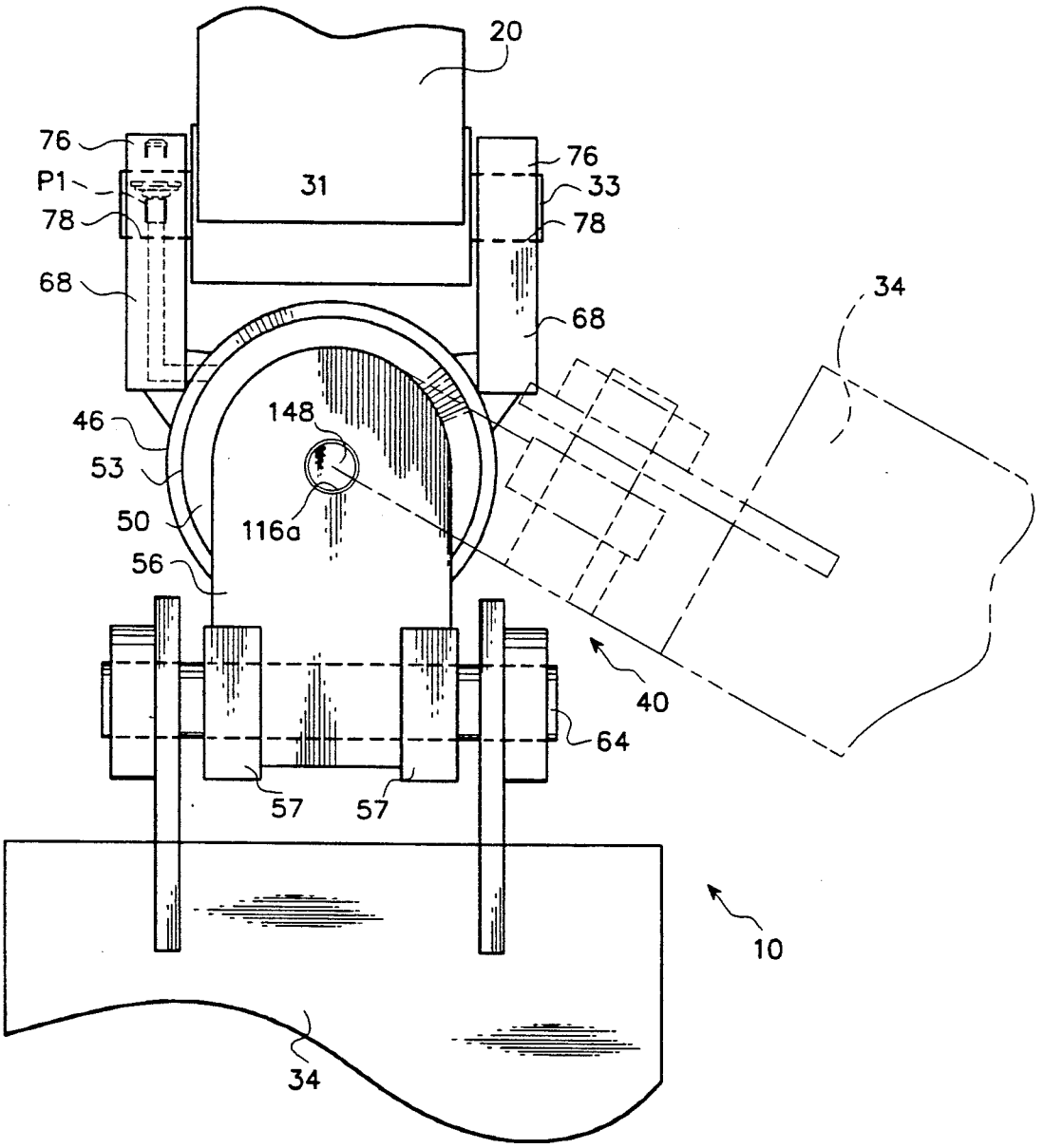
FIG. 6 is an enlarged, fragmentary, front elevational view of the bucket assembly of FIG. 1, with the bucket shown in phantom line rotated to a laterally tilted position.

The bucket assembly 10 of the present invention further includes a rotary actuator 40. As best shown in FIG. 4, the actuator 40 has an elongated housing or body 42 with a cylindrical sidewall 44 and first and second ends 46 and 48, respectively. An elongated rotary drive or output shaft 50 is coaxially positioned within the body 42 and supported for rotation relative to the body.

The shaft 50 extends the full length of the body 12, and has a flange portion 52 at the first body end 46, and an exteriorly extending shaft portion 53 extending exterior of the body at the first body end. The shaft 50 has an annular carrier or shaft nut 54 threadably attached thereto at the second body end 48. The shaft nut 54 has a threaded interior portion threadably attached to a correspondingly threaded perimeter portion 55 of the shaft 50 and the shaft nut rotates with the shaft. The shaft nut 54 is locked in place against rotation by a set screw 54*a*. A seal 54*b* is disposed between the shaft nut 54 and the shaft 50 to provide a fluid-tight seal therebetween. Seals 52*a* are disposed between the shaft flange portion 52 and the body sidewall 44 to provide a fluid-tight seal therebetween. A radial bearing 52*b* is disposed between the shaft flange portion 52 and the body sidewall 44 to support the shaft 50 against radial thrust loads.

A first attachment flange 56 is positioned outward of the body 42 at the first body end 46 and is fixedly attached to the exteriorly extending shaft portion 53 at the first body end for rotation with the shaft relative to the body 42. The first attachment flange 56 abuts against the outward end face of the shaft flange portion 52 for support. The first attachment flange 56 has the rotational drive of the shaft 50 transmitted thereto so as to provide the torque needed for tilting the bucket 34 to the desired lateral tilt angle and for holding the bucket in that position while the bucket performs the desired work. The first attachment flange 56 does not move axially relative to the body 12.

The first attachment flange 56 extends radially beyond the body sidewall 44 downwardly toward the bucket 34, and terminates in a pair of laterally spaced-apart forks 57 which faces generally toward the second body end 48.

As will be described in greater detail below, a member 58 is provided at the second body end 48 which is selectively extendable relative to the shaft 50. The member 58 has a second attachment flange 60 formed as an integral part thereof. The second attachment flange 60 is positioned outward of the body 12 at the second body end 48 for rotation with the shaft 50 relative to the body 42, as does the first attachment flange 56. The second attachment flange 60 extends radially beyond the body sidewall 44 downwardly toward the bucket 34, and terminates in a pair of laterally spaced-apart forks 61 which faces generally toward the first body end 46.

While the second attachment flange 60 is securely attached to the extendable member 58, and through the extendable member to the shaft 50, it is not constructed to transmit rotational drive to the bucket 34 to provide the torque needed to tilt the bucket, as is the first attachment flange 56. Nevertheless, the second attachment flange 60 will rotate with the shaft 50 as a result of the rotational drive transmitted thereto through the first attachment flange 56 via the bucket 34 to which the first and second attachment flanges 56 and 60 are attached. The second attachment flange 60 primarily serves to transmit the rotational force to the bucket 34 produced by the movement of the rotation link 24 relative to the second arm 20 in order to cause the bucket to be selectively rotated through the forward rotation plane. The entire bucket assembly 10, and hence the bucket 34 comprising a part thereof, rotates about the attachment pin 33 of the second arm 20 as the rotation link 24 is moved relative to the second arm by the hydraulic cylinder 30. As will be described below, the body 42 of the actuator 40 is pivotally attached to the second arm 20 and the rotation link 24, much in the same manner as a conventional bucket would be attached.

The attachment of the bucket 34 to the first and second attachment flanges 56 and 60 will be described for the bucket being attached with its working edge 35 located toward the vehicle 12, but it should be understood that the bucket and most any other tool used with the actuator 40 can be reversed. The forks 57 of the first attachment flange 56 are spaced apart and have grooves sized for mating with the corresponding first bucket clevis 36, and the forks 61 of the second attachment flange 60 are spaced apart and have grooves sized for mating with the corresponding second bucket clevis 38 for releasable attachment of the bucket 34 to the actuator 40 at a position therebelow. Each of the first and second bucket clevises 36 and 38 includes a laterally extending pin 64. Each fork of the pair of forks 57 is oriented with its groove opening toward a corresponding fork of the other pair of forks 61. The grooves are sized to receive the pins 64 of the first and second clevises 36 and 38 therein and securely, but releasably, hold the bucket 34 in place for work, as shown in FIG. 1.

As will be described below, when the extendable member 58 is retracted to a locking position, with the second attachment flange 60 moved toward the first attachment flange 56, the pins 64 of the bucket 34 are clamped between the pairs of forks 57 and 61. When the extendable member 58 is extended to a release position, with the second attachment flange 60 moved away from the first attachment flange 56 greater than the distance between the pins 64 of the bucket 34, the pins are released from the pairs of forks 57 and 61, and the bucket 34 can be removed and replaced with another tool. By the use of selectively extendable member 58, the bucket 34 can be quickly and conveniently removed from the actuator 40 for attachment of another tool, or reversal of the bucket. This allows for quick and easy attachment of a different size or style bucket or other tool to the actuator as the job demands. Also, the extendable member 58 can be adjusted to move the pairs of forks 57 and 61 apart by selected distances of varying amounts to accommodate buckets and other tools with pins 64 having different inter-pin spacing, and thereby still securely clamp the pins between the pairs of forks.

It should be noted that while the forks 57 and 61 are shown and described as being inwardly facing, for buckets and other tools with larger spacing between the pins 64 the forks can be reversed. When reversed, the forks would be positioned between the pins 64 and the extendable member 58 extended axially outward of the shaft 50 to reach the locking position with the forks securely engaging the pins, and retracted to release the pins. With such an arrangement, other changes in the internal design of the actuator 40 would be made since the larger force which is required for the forks 57 and 61 to securely engage the pins 64 would be when extending the extendable member 58, rather than when retracting the extendable member, as is the case with the illustrated embodiment of the invention.

A pair of attachment brackets 68 is used to detachably connect the body 42 to the second arm 20 and the rotation link 24 in a position therebelow in general alignment with the forward rotation plane. The attachment brackets 68 are rigidly attached to the body sidewall 44. The attachment brackets 68 form a first attachment clevis 76 with an aperture 78 therein sized to receive one of the attachment pins 33 to pivotally connect the body 42 to the vehicle second arm 20 at its free end portion 31, and a second attachment clevis 80 with an aperture 82 therein sized to receive the other of the attachment pins 33 to pivotally connect the body to the rotation link 24 at its free end portion 32. By the use of selectively removable attachment pins 33, the bucket assembly 10 can be quickly and conveniently removed from the second arm 20 and the rotation link 24 when use of the bucket assembly is not desired.

With the tiltable bucket assembly 10 of the present invention, a compact, fluid-powered actuator 40 is used with a design which requires far less space, particularly with respect to the size in the lateral direction compared to when using double-acting cylinders to rotate a tilt bucket. This allows the construction of a tiltable bucket assembly with a very narrow width bucket. Furthermore, the bucket assembly can be used with conventional buckets and thus can be retrofitted onto vehicles with existing buckets without requiring purchase of a new bucket.

An annular piston sleeve 84 is coaxially and reciprocally mounted within the body 42 coaxially about the shaft 50. The piston sleeve 84 has outer helical splines 86 over a portion of its length which mesh with inner helical splines 88 of a splined intermediate interior portion of the body sidewall 44. The piston sleeve 84 is also provided with inner helical splines 90 which mesh with outer helical splines 92 provided on a splined end portion of the shaft 50 toward the first body end 46. The shaft flange portion 52 has a circumferentially extending recess **52*c* which opens facing toward the second body end 48 and is sized to receive a lengthwise portion of the spliced piston sleeve 84 therein when it moves axially toward the first body end 46**. It should be understood that while helical splines are shown in the drawings and described herein, the principle of the invention is equally applicable to any form of linear-to-rotary motion conversion means, such as balls or rollers.

In the illustrated embodiment of the invention, the piston sleeve 84 has an annular piston head 94 positioned toward the second body end 40 with the shaft 50 extending therethrough. The piston head 94 is slidably maintained within the body 42 for reciprocal movement, and undergoes longitudinal and rotational movement relative to a smooth interior wall surface 96 of the body sidewall 44, as will be described in more detail below.

Seals 98 are disposed between the piston head 94 and the interior wall surface 96 of the body sidewall 44 to provide a fluid-tight seal therebetween. Seals 100 are disposed between the piston head 94 and a smooth exterior wall surface 102 of the shaft 50 to provide a fluid-tight seal therebetween.

As will be readily understood, reciprocation of the piston head 94 within the body 42 occurs when hydraulic oil, air or any other suitable fluid under pressure selectively enters through one or the other of a first port P1 which is in fluid communication with a fluid-tight compartment within the body to a side of the piston head toward the first body end 46 or through a second port P2 which is in fluid communication with a fluid-tight compartment within the body to a side of the piston head toward the second body end 48. As the piston head 94 and the piston sleeve 84, of which the piston head is a part, linearly reciprocates in an axial direction within the body 40, the outer helical splines 86 of the piston sleeve engage or mesh with the inner helical splines 88 of the body sidewall 44 to cause rotation of the piston sleeve. The linear and rotational movement of the piston sleeve 84 is transmitted through the inner helical splines 90 of the piston sleeve to the outer helical splines 92 of the shaft 50 to cause the shaft 50 to rotate. The smooth wall surface 102 of the shaft 50 and the smooth wall surface 96 of the body sidewall 44 have sufficient axial length to accommodate the full end-to-end reciprocating stroke travel of the piston sleeve 84 within the body 42. Longitudinal movement of the shaft 50 is restricted, thus all movement of the piston sleeve 84 is converted into rotational movement of the shaft 50. Depending on the slope and direction of turn of the various helical splines, there may be provided a multiplication of the rotary output of the shaft 50.

The application of fluid pressure to the first port P1 produces axial movement of the piston sleeve 84 toward the second body end 48. The application of fluid pressure to the second port P2 produces axial movement of the piston sleeve 84 toward the body first end 46. The actuator 40 provides relative rotational movement between the body 42 and shaft 50 through the conversion of linear movement of the piston sleeve 84 into rotational movement of the shaft, in a manner well known in the art. The shaft 50 is selectively rotated by the application of fluid pressure, and the rotation is transmitted to the bucket 34 through the first attachment flange 56 to selectively tilt the bucket laterally, left and right.

The actuator 40 includes an insert 104 having an annular sidewall portion 106 with a central aperture. The sidewall portion 106 of the insert 104 is coaxially positioned within the body 40 at the second body end 48, and has its central aperture sized to rotatably receive the shaft nut 54 therein. An exterior ball race is formed on the shaft nut 54, and an interior ball race is formed on the insert sidewall 106 portion confronting and corresponding to the shaft nut ball race. The shaft nut and second insert ball races extend circumferentially, fully about the shaft nut 50 and form a set of races. A plurality of steel bearings 108 are seated in the set of races and rotatably support the shaft nut 54 for rotational movement of the shaft 50 relative to the body 42. The set of races with the ball bearings 108 therein serves to support the shaft 50 against moment loads and both radial and axial thrust loads.

The insert 104 has a circumferentially extending flange 110 positioned exterior of the body 42 and projecting outward beyond the second body end 48 to engage an endwall of the body sidewall 44 and prevent inward axial movement of the insert during fluid-powered operation of the actuator 40.

A seal 112 is disposed between the insert 104 and the body sidewall 44. A pair of seals 114 is disposed between the insert 104 and the shaft nut 54. The seals 112 and 114 provide fluid-tight seals which prevent fluid leakage from the body 42.

The shaft 50 has an axially extending central aperture 116 which extends fully between the first and second body ends 46 and 48 and terminates at the first body end 46 in an opening 116*a* and at the second body end 46 in an opening 116*b*. The shaft aperture 116 has an interiorly threaded intermediate portion 118, an enlarged smooth-walled portion 120 which extends from the threaded aperture portion to the opening 116*b* at the second body end 48, and a portion 122 which extends from the threaded aperture portion to the opening 116*a* at the first body end 46. The extendable member 58 is slidably disposed in the smooth-walled aperture portion 120 and extends out of the opening 116*b* at the second body end 48.

The second attachment flange 60 is located at an end portion 124 of the extendable member 58 which is positioned outward of the body 42. Except as described below, the extendable member 58 is freely axially movable and rotatable within the smooth-walled aperture portion 120. The rotation of the extendable member 58 is limited by its connection through the bucket 34 to the first attachment flange 56 which is rigidly connected to the shaft 50 at the first body end 46. The axial movement of the extendable member 58 is limited by an actuator screw 126 on which it is mounted for axial travel therewith.

The screw 126 is coaxially received in the shaft aperture 116 and has a threaded end portion 128 which is threadably received in the correspondingly threaded aperture portion 118. The threaded end portion 128 of the screw 126 extends into the aperture portion 122 of the shaft aperture 116 and the aperture portion has sufficient axial length to accommodate the axial travel of the screw 126 toward the first body end 46 that results when the screw is rotated.

The screw 126 also has a smooth-walled portion 130 which extends from its threaded end portion 128 through a smooth-walled central aperture 132 in the extendable member 58 and terminates in a head 134 located axially outward of the second attachment flange 60. The extendable member 58 is retained on the smooth-walled portion 130 of the screw 126 against axial movement toward the first body end 46 by a retainer clip 136 which is received in a circumferential groove 138 the screw, and against axial movement toward the second body end 48 by the head 134. A spring washer 140 is disposed between the head 134 and the extendable member 58. A seal 142 is disposed between the smooth-walled portion 130 of the screw 126 and the smooth-walled central aperture 132 of the extendable member 58 to keep contaminants out.

The extendable member 58 is selectively axially movable to selectively extend the extendable member relative to the shaft 50 by rotation of the screw 126. The rotation of the screw 126 moves the extendable member 58 between the locking position, with the second attachment flange 60 adjacent to the second body end 48 so that the pairs of forks 57 and 61 are close enough together to clamp the pins 64 of the bucket 34 securely therebetween, and the release position, with the second attachment flange moved axially a sufficient distance away from the second body end so that the pairs of forks 57 and 61 are spaced apart sufficiently to release the pins 64 of the bucket 34.

The screw 126 is rotated to selectively extend or retract the extendable member 58 by use of a tool (not shown) which is sized to operatively engage the head 134 of the screw. When the screw 126 is rotated to advance the screw inward toward the first body end 46, the head 34 through the washer 140 forces the extendable member 58 into the smooth-walled portion 120 of the shaft aperture 116 to retract the extendable member until it reaches the locking position with the pairs of forks 57 and 61 securely clamping the pins 64 of the bucket 34 therebetween. Of course, the exact position of the "locking position" relative to the shaft 50 is dependent upon the particular inter-pin spacing of the particular bucket being used. The locking position changes when buckets or other tools with different inter-pin spacings are used.

The maximum inter-pin spacing that the extendable member 58 can accommodate is illustrated by the placement of the pin 64' shown in phantom line in FIG. 4. The minimum inter-pin spacing that the extendable member 58 can accommodate is illustrated by the placement of the pin 64 shown in solid line in FIG. 4. These maximum and minimum inter-pin spacings are so in FIG. 4. It is noted that to allow removal of the bucket 34 when the maximum inter-pin spacing is encountered, the second attachment flange 60 must be axially moved by the extendable member 58 to position the forks 61 thereof to the position of the forks 61' shown in phantom line in FIG. 4 so that the corresponding pin 64' of the bucket 34 can clear the forks 61.

When the screw 126 is rotated to advance the screw outward toward the second body end 48, the clip 136 forces the extendable member 58 out of the smooth-walled portion 120 of the shaft aperture 116 through the opening 116*b* to extend the extendable member until it reaches the release position with the pairs of forks 57 and 61 spaced far enough apart to release the pins 64 of the bucket 34 and allow removal of the bucket and attachment of another tool, or reversal of the bucket. The exact "release position" relative to the shaft 50 is dependent on the particular inter-pin spacing of the bucket being used and changes when buckets or other tools with different inter-pin spacings are used. To prevent the rotation of the screw 126 outward so much that it clears the threads of the threaded portion 118 of the shaft aperture 116, a washer 144 is held in place by a bolt 146 on the end face of the screw threaded end portion 128. The washer 144 has a diameter which prevents it from being pulled through the threaded aperture portion 118. Access to the bolt 146 is achieved through the opening 116*a* at the first body end 46, and the opening is closed by use of a cap 148 to keep out contaminants.

It will be appreciated that, although a specific embodiment of the invention has been described herein for purposes of illustration, various modifications may be made without departing from the spirit and scope of the invention. Accordingly, the invention is not limited except as by the appended claims.

I claim:

1. A fluid-powered laterally tiltable bucket assembly, usable with a vehicle having an arm and a rotation link associated therewith for rotation of the bucket assembly in a first plane defined by movement of the rotation link relative to the arm, each of the arm and rotation link having an attachment member located toward a free end thereof, the bucket assembly comprising:

a bucket having a working edge extending laterally, generally transverse to the first plane, a first bucket attachment member and a second bucket attachment member located away from said first bucket attachment member, said first and second bucket attachment members being arranged in general parallel alignment with the first plane;

a body having a longitudinal axis and first and second ends;

an attachment bracket rigidly attached to said body and having an external first bracket attachment member located generally along said body axis for pivotal attachment to the vehicle arm by the arm attachment member and an external second bracket attachment member located generally along said body axis away from said first bracket attachment member for pivotal attachment to the rotation link by the rotation link attachment member, said first and second bracket attachment members being selectively detachable from the arm and rotation link attachment members, wherein with said first and second bracket attachment members attached tot he arm and rotation link attachment members, movement of the rotation link causes said body to rotate about the vehicle arm with movement of said longitudinal axis of said body in generally parallel alignment with the first plane, and wherein the bucket assembly is selectively detachable from the vehicle arm and rotation link;

an output shaft rotatably disposed within said body in general coaxial arrangement with said body and having a first shaft end portion extending at least to said first body end and a second shaft end portion extending toward said second body end, said first shaft end portion having a first shaft attachment member attached thereto which is releasably attachable to said first bucket attachment member;

a member longitudinally extendable relative to said second shaft end portion, said extendable member having a second shaft attachment member attached thereto which is releasably attachable to said second bucket attachment member, said extendable member being selectively longitudinally movable between a locking position with said first and second shaft attachment members positioned to attach said bucket to said shaft for rotation with said shaft through a second plane extending laterally, generally transverse to the first plane and a release position with said first and second shaft attachment members positioned to allow disconnection of said bucket from said shaft;

an actuator engaging said extendable member for selectively moving said extendable member between said locking and release positions; and a linear-to-rotary torque transmitting member mounted for longitudinal movement within said body in response to selective application of pressurized fluid thereto, said torque-transmitting member engaging said body and said shaft to translate longitudinal movement of said shaft relative to said body, whereby said bucket is rotatable in the first plane and laterally tiltable in the second plane.

2. The bucket assembly of claim 1 wherein said second shaft end portion has a longitudinally extending aperture therein with an open end toward said second body end, and said extendable member has a first end portion longitudinally movably disposed within said shaft aperture and a second end portion extending out of said shaft open end, said second shaft attachment member being attached to said extendable member second end portion, and wherein said actuator selectively moves said extendable member first end portion longitudinally within said shaft aperture sufficiently to move said extendable member between said locking and release positions.

3. The bucket assembly of claim 2 wherein said shaft is restrained against longitudinal movement relative to said body, and said second shaft attachment member when in said locking position is positioned adjacent to said second body end and when in said release position is positioned farther away from said second body end than when in said locking position.

4. The bucket assembly of claim 2 wherein said first shaft end portion has an interiorly threaded aperture, and said actuator includes a screw having a threaded portion threadably received in said shaft threaded aperture and a mounting portion to which said extendable member is mounted for longitudinal movement with said screw, said screw being selectively rotatable relative to said shaft to rotate said screw threaded portion within said shaft threaded aperture and thereby selectively move said screw longitudinally relative to said shaft, said screw threaded portion having a sufficient length when rotated to longitudinally move said extendable member between said locking and release positions.

5. The bucket assembly of claim 2 wherein said first shaft end portion has an interiorly threaded aperture, said extendable member has an aperture, and said actuator includes a screw having a threaded portion threadably received in said shaft threaded aperture and a mounting portion extending into and freely rotatable within said extendable member aperture, said screw being selectively rotatable relative to said shaft to rotate said screw threaded portion within said shaft threaded aperture and thereby selectively move said screw longitudinally relative to said shaft, said extendable member being mounted to said screw mounting portion for longitudinal movement with said screw, said screw threaded portion having a sufficient length when rotated to longitudinally move said extendable member between said locking and release positions.

6. The bucket assembly of claim 5 wherein said screw further has a terminal end portion projecting outward beyond said extendable member aperture toward said second body end and engageable by a tool for selectively rotating said screw to move said extendable member between said locking and release positions.

7. The bucket assembly of claim 2 wherein said extendable member first end portion is slidably disposed within said shaft aperture.

8. The bucket assembly of claim 1 wherein said first shaft attachment member includes a pair of laterally spaced-apart forks and said second shaft attachment member includes a pair of laterally spaced-apart forks, and wherein said first and second bucket attachment members each includes a laterally extending pin, each pin being positioned to be engaged and retained by one of said pairs of forks for rotation and lateral tilting of said bucket when said extendable member is in said locking position, and said pair of forks comprising said second shaft attachment member being positioned to disengage said pin when said extendable member is in said release position to allow removal of said bucket.

9. A fluid-powered laterally tiltable bucket assembly, usable with a vehicle having an arm and a rotation link associated therewith for rotation of the bucket assembly in a first plane defined by movement of the rotation link relative to the arm, each of the arm and rotation link having an attachment member located toward a free end thereof, the bucket assembly comprising:

a bucket having a working edge extending laterally, generally transverse to the first plane, a first bucket attachment member and a second bucket attachment member located away from said first bucket attachment member, said first and second bucket attachment members being arranged in general parallel alignment with the first plane;

a body having a longitudinal axis and first and second ends;

an attachment bracket rigidly attached to said body and having an external first bracket attachment member located generally along said body axis for pivotal attachment to the vehicle arm by the arm attachment member and an external second bracket attachment member located generally along said body axis away from said first bracket attachment member for pivotal attachment to the rotation link by the rotation link attachment member, said first and second bracket attachment members being selectively detachable from the arm and rotation link attachment members, wherein with said first and second bracket attachment members attached to the arm and rotation link attachment members, movement of the rotation link causes said body to rotate about the vehicle arm with movement of said longitudinal axis of said body in generally parallel alignment with the first plane, and wherein the bucket assembly is selectively detachable from the vehicle arm and rotation link;

an output shaft rotatably disposed within said body in general coaxial arrangement with said body and having a first shaft end portion extending at least to said first body end and a second shaft end portion extending toward said second body end, said first shaft end portion having a first shaft attachment member attached thereto which is releasably attachable to said first bucket attachment member;

a member longitudinally extendable relative to said second shaft end portion, said extendable member having a second shaft attachment member attached thereto which is releasably attachable to said second bucket attachment member, said extendable member being selectively longitudinally movable between a locking position with said first and second shaft attachment members positioned to attach said bucket to said shaft for rotation with said shaft through a second plane extending laterally, generally transverse to the first plane and a release position with said first and second shaft attachment members positioned to allow disconnection of said bucket from said shaft;

actuation means engaging said extendable member, for selectively moving said extendable member relative to said second shaft end portion between said locking and release positions; and a linear-to-rotary torque transmitting member mounted for longitudinal movement within said body in response to selective application of pressurized fluid thereto, said torque-transmitting member engaging said body and said shaft to translate longitudinal movement of said torque-transmitting member into rotational movement of said shaft relative to said body, whereby said bucket is rotatable in the first plane and laterally tiltable in the second plane.

10. The bucket assembly of claim 9 wherein said second shaft end portion has a longitudinally extending aperture therein with an open end toward said second body end, and said extendable member has a first end portion longitudinally movably disposed within said shaft aperture and a second end portion extending out of said shaft open end, said second shaft attachment member being attached to said extendable member second end portion, and wherein said actuation means includes a selectively operable actuator for selectively moving said extendable member first end portion longitudinally within said shaft aperture sufficiently to move said extendable member between said locking and release positions.

11. The bucket assembly of claim 10 wherein said shaft is restrained against longitudinal movement relative to said body, and said second shaft attachment member when in said locking position is positioned a first distance from said second body end and when in said release position is positioned a second distance from said second body end greater than said first distance.

12. The bucket assembly of claim 10 wherein said first shaft end portion has an interiorly threaded aperture, and said actuator includes a screw having a threaded portion threadably received in said shaft threaded aperture and a mounting portion to which said extendable member is mounted for longitudinal movement with said screw, said screw being selectively rotatable relative to said shaft to rotate said screw threaded portion within said shaft threaded aperture and thereby selectively move said screw longitudinally relative to said shaft, said screw threaded portion having a sufficient length when rotated to longitudinally move said extendable member between said locking and release positions.

13. The bucket assembly of claim 12 wherein said screw further has a terminal end portion positioned outward beyond said second body end and engageable by a tool for selectively rotating said screw to move said extendable member between said locking and release positions.

14. The bucket assembly of claim 12 wherein said extendable member first end portion is slidably disposed within said shaft aperture.

15. The bucket assembly of claim 9 wherein said first shaft attachment member includes a pair of laterally spaced-apart forks and said second shaft attachment member includes a pair of laterally spaced-apart forks, and wherein said first and second bucket attachment members each includes a laterally extending pin, each pin being positioned to be engaged and retained by one of said pairs of forks for rotation and lateral tilting of said bucket when said extendable member is in said locking position, and said pair of forks comprising said second shaft attachment member being moved to a position sufficiently spaced away from said pair of forks comprising said first shaft attachment member to permit said pair of pins to be disengaged from said pairs of forks when said extendable member is in said release position.

16. A fluid-powered tool actuator, usable with a vehicle having an arm and a rotation link associated therewith for rotation of a tool in a first plane defined by movement of the rotation link relative to the arm, each of the arm and rotation link having an attachment member located toward a free end thereof, and usable with a tool having a first tool attachment member and a second tool attachment member located away from the first tool attachment member, the first and second tool attachment members being arranged in general parallel alignment with the first plane, the tool actuator comprising:

a body having a longitudinal axis and first and second ends;

an attachment bracket rigidly attached to said body and having an external first bracket attachment member located generally along said body axis for pivotal attachment to the vehicle arm by the arm attachment member and an external second bracket attachment member located generally along said body axis away from said first bracket attachment member for pivotal attachment to the rotation link by the rotation link attachment member, said first and second bracket attachment members being selectively detachable from the arm and rotation link attachment members, wherein with said first and second bracket attachment members attached to the arm and rotation link attachment members, movement of the rotation link causes said body to rotate about the vehicle arm with movement of said longitudinal axis of said body in generally parallel alignment with the first plane, and wherein the tool actuator is selectively detachable from the vehicle arm and rotation link;

an output shaft rotatably disposed within said body in general coaxial arrangement with said body and having a first shaft end portion extending at least to said first body end and a second shaft end portion extending toward said second body end, said first shaft end portion having a first shaft attachment member attached thereto which is releasably attachable to said first bucket attachment member;

a member longitudinally extendable relative to said second shaft end portion, said extendable member having a second shaft attachment member attached thereto which is releasably attachable to said second bucket attachment member, said extendable member being selectively longitudinally movable between a locking position with said first and second shaft attachment members positioned to attach the tool to said shaft for rotation with said shaft through a second plane extending laterally, generally transverse to the first plane and a release position with said first and second shaft attachment members positioned to allow disconnection of the tool from said shaft;

an actuator engaging said extendable member for selectively moving said extendable member between said locking and release positions; and a linear-to-rotary torque transmitting member mounted for longitudinal movement within said body in response to selective application of pressurized fluid thereto, said torque-transmitting member engaging said body and said shaft to translate longitudinal movement of said torque-transmitting member into rotational movement of said shaft relative to said body, whereby the tool is rotatable in the first plane and laterally tiltable in the second plane.

17. The tool actuator of claim 16 wherein said second shaft end portion has a longitudinally extending aperture therein with an open end toward said second body end, and said extendable member has a first end portion longitudinally movably disposed within said shaft aperture and a second end portion extending out of said shaft open end, said second shaft attachment member being attached to said extendable member second end portion, and wherein said actuator selectively moves said extendable member first end portion longitudinally within said shaft aperture sufficiently to move said extendable member between said locking and release positions.

18. The tool actuator of claim 17 wherein said shaft is restrained against longitudinal movement relative to said body, and said second shaft attachment member when in said locking position is positioned adjacent to said second body end and when in said release position is positioned farther away from said second body end than when in said locking position.

19. The tool actuator of claim 17 wherein said first shaft end portion has an interiorly threaded aperture, and said member actuator includes a screw having a threaded portion threadably received in said shaft threaded aperture and a mounting portion to which said extendable member is mounted for longitudinal movement with said screw, said screw being selectively rotatable relative to said shaft to rotate said screw threaded portion within said shaft threaded aperture and thereby selectively move said screw longitudinally relative to said shaft, said screw threaded portion having a sufficient length when rotated to longitudinally move said extendable member between said locking and release positions.

20. The tool actuator of claim 17 wherein said first shaft end portion has an interiorly threaded aperture, said extendable member has an aperture, and said member actuator includes a screw having a threaded portion threadably received in said shaft threaded aperture and a mounting portion extending into and freely rotatable within said extendable member aperture, said screw being selectively rotatable relative to said shaft to rotate said screw threaded portion within said shaft threaded aperture and thereby selectively move said screw longitudinally relative to said shaft, said extendable member being mounted to said screw mounting portion for longitudinal movement with said screw, said screw threaded portion having a sufficient length when rotated to longitudinally move said extendable member between said locking and release positions.

21. The tool actuator of claim 20 wherein said screw further has a terminal end portion projecting outward beyond said extendable member aperture toward said second body end and engageable by an operator for selectively rotating said screw to move said extendable member between said locking and release positions.

22. The tool actuator of claim 17 wherein said extendable member first end portion is slidably disposed within said shaft aperture.

23. The tool actuator of claim 16, for use with a tool having the first and second tool attachment members each including a laterally extending pin, wherein said first shaft attachment member includes a pair of laterally spaced-apart forks facing generally toward one of said pins and said second shaft attachment member includes a pair of laterally spaced-apart forks facing generally toward the other of said pins, said pairs of forks being positioned to each engage and retain one of said pins for rotation and lateral tilting of the tool when said extendable member is in said locking position, said pair of forks comprising said second shaft attachment member being positioned to disengage the corresponding pin when said extendable member is in said release position to allow removal of the tool.

* * * * *

UNITED STATES PATENT AND TRADEMARK OFFICE

CERTIFICATE OF CORRECTION

PATENT NO. : 5,145,313

DATED : September 8, 1992

INVENTOR(S) : Paul P. Weyer

It is certified that error appears in the above-identified patent and that said Letters Patent is hereby corrected as shown below:

In column 11, claim 1, line 31, please delete "tot he" and substitute therefor -- to the --.

In column 11, claim 1, line 68, after "said" please insert -- torque-transmitting member into rotational movement of said --.

In column 15, claim 16, line 44, please delete "said first bucket" and substitute therefor -- the first tool --.

In column 15, claim 16, line 48 and 49, please delete "said second bucket" and substitute therefor -- the second tool --.

Signed and Sealed this

Nineteenth Day of October, 1993

Bruce Lehman

*Attest:*

BRUCE LEHMAN

*Attesting Officer*

*Commissioner of Patents and Trademarks*